United States Patent [19]

Boulanger

[11] Patent Number: 4,782,318

[45] Date of Patent: Nov. 1, 1988

[54] THERMALLY RESPONSIVE ELECTRIC SWITCH APPARATUS

[75] Inventor: Henry J. Boulanger, Nicholasville, Ky.

[73] Assignee: Texas Instruments Incorporated, Dallas, Tex.

[21] Appl. No.: 84,528

[22] Filed: Aug. 12, 1987

[51] Int. Cl.[4] ..... H01H 37/04; H01H 37/52

[52] U.S. Cl. ..... 337/380; 337/112; 337/372

[58] Field of Search ..... 337/380, 112, 372, 365

[56] References Cited

U.S. PATENT DOCUMENTS 4,392,608 7/1983 Blades ..... 337/380

*Primary Examiner*—H. Broome

*Attorney, Agent, or Firm*—John Haug; James McAndrews; Melvin Sharp

[57] ABSTRACT

A thermally responsive electric switch has an open ended, cup shaped, thermally and electrically conductive housing containing a thermostatic disc. A base of electrically insulative material, mounting a stationary contact arm, is received in the open end of the housing and captures an end of a movable contact arm between the base and the housing. The movable contact arm extends through a window in the stationary contact arm and has an opposite end disposed adjacent to the outer periphery of the disc and is adapted to be moved by the disc when it snaps from an unactuated to an actuated configuration to thereby control switch actuation.

9 Claims, 2 Drawing Sheets

THERMALLY RESPONSIVE ELECTRIC SWITCH APPARATUS

BACKGROUND OF INVENTION

The present invention relates generally to electric switches and more particularly to thermally responsive electric switches.

Many types of thermally responsive electric switches are known in the art, however, there is a need for an improved, low cost switch to be used, for example, in automatic transmissions to sense the temperature of the oil so that the operation of a torque converter can be controlled thereby. In this application very little space is available for such a switch yet a reliable, low cost, oil tight construction is required.

It is an object of the present invention therefore to provide a thermally responsive electric switch which is insensitive to vibration, rugged yet reliable. It is another object to provide a switch which has a minimum number of component parts to minimize cost. Yet another object is the provision of a switch which has relatively high contact opening forces and one which actuates at a selected temperature on temperature rise and has a selected temperature differential for deactuation.

Other objects and a fuller understanding of the invention may be had by referring to the following description and claims taken in conjunction with the accompanying drawings.

BRIEF DESCRIPTION OF THE INVENTION

Briefly, in accordance with the invention a generally cup shaped housing formed of material having good electrical and thermal conductivity has a threaded shank extending downwardly from a bottom wall, and a generally cylindrical side wall extending upwardly from the bottom wall to form a switch chamber and an open end. A recessed portion in the bottom wall serves as a seat for a thermostatic, snap acting disc and is formed with a centrally disposed projection forming a fulcrum for the disc to react against when snapping from an unactuagtd (upwardly convex) to an actuated (upwardly concave) configuration. A base member formed of electrically insulative material has a generally cylindrical side wall which is telescopically received within the side wall of the housing bottoming out against the bottom wall. A movable contact arm is cantilever mounted by means of a U-shaped portion formed at one end snapped onto a mounting portion formed on the side wall of the base member and captured between the housing and the base. The distal free end of the U-shaped portion is bent outwardly so that it is in scraping engagement with the housing side wall. According to a feature of the invention, a stationary contact arm, mounted on the base at one end by a connector, is formed with a window with the stationary contact secured to a bridge portion defining the outer portion of the window at the free distal end of the stationary contact arm. The movable contact arm which carries a movable contact adapted to move into and out of engagement with the stationary contact extends through the window and has a tab portion extending from the free distal end of the movable contact arm into the recessed portion in the bottom wall adjacent the outer periphery of the thermostatic disc. According to a feature of the invention the the bridge portion of the stationary contact member has opposite side end portions supported on the base with the bridge portion extending therebetween being bendable to permit calibration.

DETAILED DESCRIPTION OF PREFERRED EMBODIMENT

Figure 1:
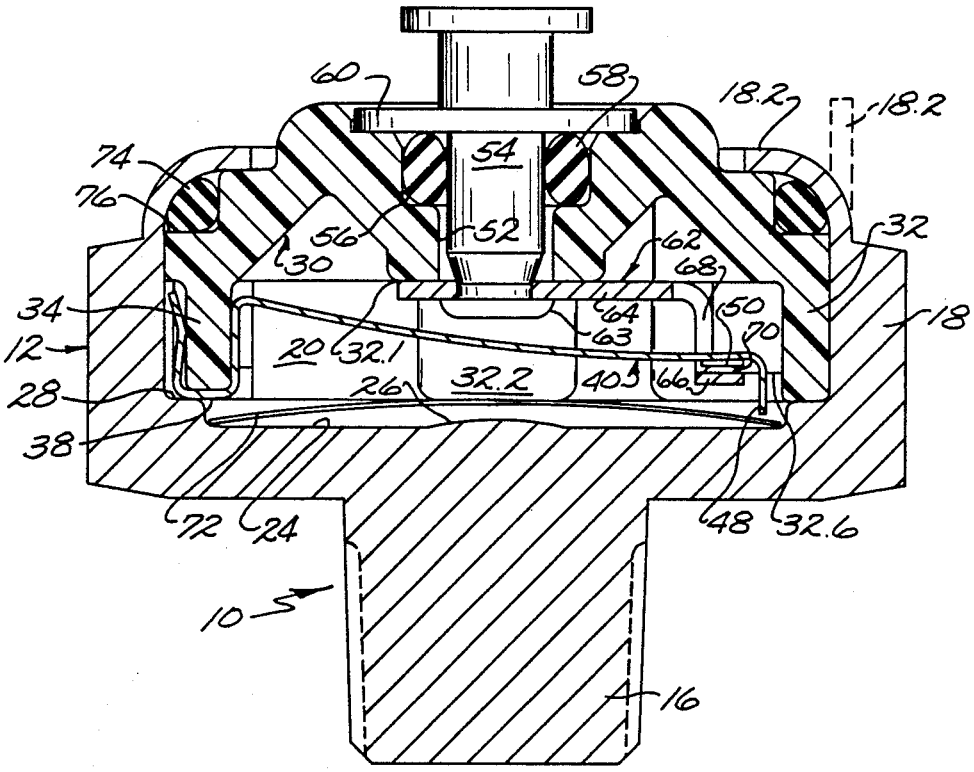
FIG. 1 is a cross section of an elevational view of a switch made in accordance with the invention.
Figure 2:
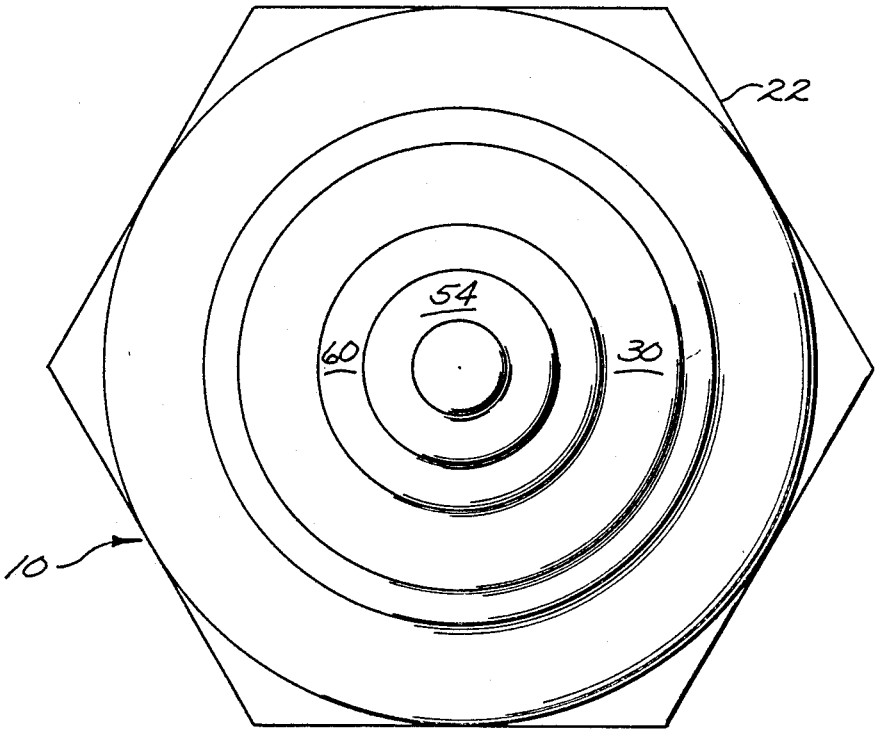
FIG. 2 is a top plan view of the FIG. 1 switch.

A switch made in accordance with the invention, generally designated by numeral 10, comprises a housing 12 formed of good electrical and heat conductive material such as CDA 360 brass and has bottom wall 14 from which a threaded stud portion 16 depends downwardly for mounting in a threaded aperture of a member whose temperature is to be monitored or which contains a fluid whose temperature is to be monitored. Side wall 18 extends upwardly from bottom wall 14 to define a switch chamber 20 open at the top. The outer periphery of side wall 18 preferably has a hexagonal configuration as indicated at 22 in FIG. 2 to facilitate mounting and demounting of switch 10 in a threaded aperture. Bottom wall 14 is formed with a recessed portion 24 open to chamber 20 to receive a thermostatic disc to be described below. Preferably a centrally disposed projection 26 is formed in the bottom wall 14 to serve as a fulcrum also to be described below. The annular portion 28 of bottom wall 14 between recessed portion 24 and side wall 18 serves as a seat for a base 30.

Base 30 is formed of electrically insulative material such as a thermoplastic polyester preferably capable of withstanding relatively high temperatures, e.g., in the order of approximately 300 deg. F. Base 30 has a downwardly depending side wall 32 about its outer periphery which is generally cylindrical in configuration except for movable arm mounting portion 34, a flat section formed integrally with side wall 32 extending parallelly to the longitudinal axis of the cylindrical side wall and having an outer face 36 (FIG. 3) located slightly inwardly of the imaginary continuation of the cylindrical side wall 32 aligned with mounting portion 34. The distal free end 38 of mounting portion 34 is displaced in a direction parallel to the longitudinal axis of wall 32 an amount approximately equal to the thickness of the movable arm so that such an arm can be received and securely maintained intermediate the housing and the base.

An elongated movable contact arm 40 made out of material having good electrical and spring properties, such as Olin alloy C724 is preferably generally trapezoidal in configuration having two parallel ends 42, 44 and an intermediate generally flat portion 46 with one end 42 having a width approximately equal to the length of arm mounting portion 34 formed into a generally U-shaped configuration with its free distal end 49 bent outwardly. The other relatively narrow end 44 has a distal end portion 48 bent in the same direction as the U-shaped configuration 42 and has a movable contact 50 secured by conventional means on flat portion 46 adjacent portion 48. Portion 46 is formed relative to U-shaped portion 42 with an angle of approximately 70 degrees for a purpose to be described below.

Base 30 has a centrally located bore 52 which receives therethrough a connector 54. An "O" ring seat 56 in the form of a groove is formed in base 30 in communication with bore 52. "O" ring 58 is received in seat 56 and the shank of connector 54 is inserted through the "O" ring 58 and into bore 52 locking "O" ring in place by flange 60 integrally formed on connector 54. The bottom portion of the shank of connector 54 is received through an aperture in a stationary contact arm 62 which is headed over, as shown at 63, to lock arm 62 to base 30.

Stationary contact arm 62 has a first portion 64 which extends laterally toward side wall 32 with a distal free end 66 lying in a plane parallel to portion 64 but displaced in a direction toward the bottom wall of housing 12. An opening or window 68 is formed in arm 62 in the portion between laterally extending portion 64 and distal free end 66 to receive therethrough movable contact arm 40. A stationary contact 70 is secured in a conventional manner to distal free end 66.

In assembling the switch, end 44 is inserted through window 68 and U-shaped portion 42 is pushed onto movable arm mounting portion 34 until the bight portion is seated on portion 34. Mounted in this manner, due to the angle between portions 46 and 42, movable contact 50 is biased against stationary contact 70 with a selected amount of force, e.g., preferably between 40 and 70 grams, and is adapted to move out of and into engagement therewith.

A heat responsive thermostatic, snap acting disc 72 is received in recess 24 of housing 12 with its dished convex side (at normal ambient temperature) facing into the switch chamber. The disc is preferably formed so that it will snap to an oppositely dished configuration at a selected temperature, e.g., 270 deg. F., and will not snap back to the original configuration until its temperature falls a selected amount, e.g., 12 degrees. That is, the disc is selected using an actuating temperature and a differential temperature as the criteria for selection.

Figure 3:
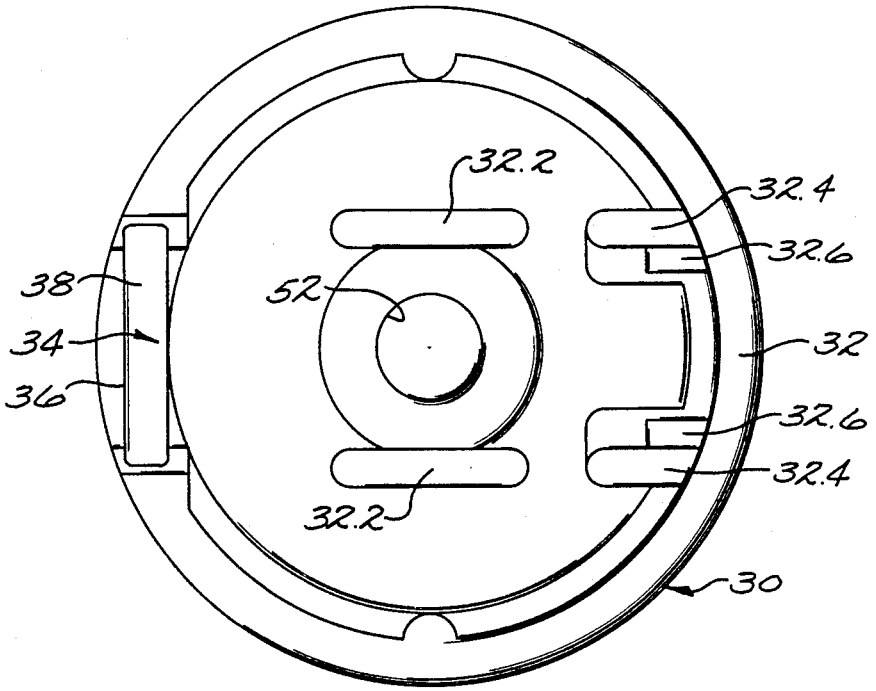
FIG. 3 is a bottom plan view of the base shown in FIG. 1.
Figure 4A:
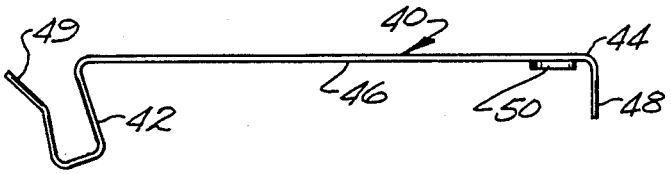
FIGS. 4*a* and 4*b* are front and bottom views respectively of the movable contact arm shown in FIG. 1.
Figure 4B:
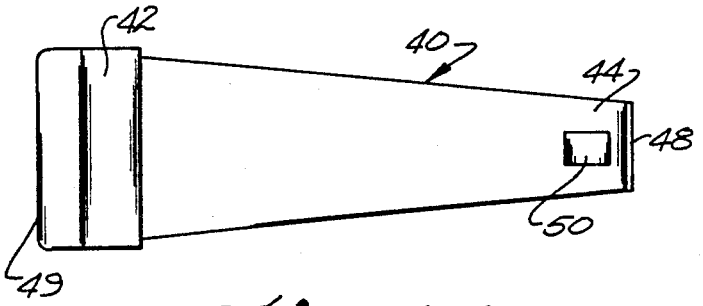

With particular reference to FIG. 3, a pair of parallelly extending guide walls 32.2 depends from base 30 essentially to a plane on which the free distal end of side wall 32 lies and are each spaced an equidistant amount from the horizontal axis of the circular surface formed by side wall 32 as seen in FIG. 3. The horizontal axis is perpendicular to and essentially bisects mounting portion 34. A second pair of parallelly extending walls 32.4 also extends from base 30 essentially to the same plane and are aligned with walls 32.2 and contiguous with side wall 32 diametrically opposed to mounting portion 34. A pair of platforms 32.6 is formed in base 30 and extends from the closed end of base 30 for a distance slightly less than does side wall 32, that is, there is a space formed between platforms 32.6 and the plane on which the distal free end of wall 32 lies.

Figure 5A:
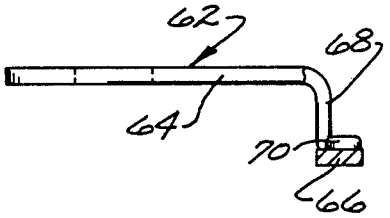
FIGS. 5*a* and 5*b* are front and bottom views respectively, with a portion of 5*a* in cross section, of the stationary contact arm shown in FIG. 1.
Figure 5B:
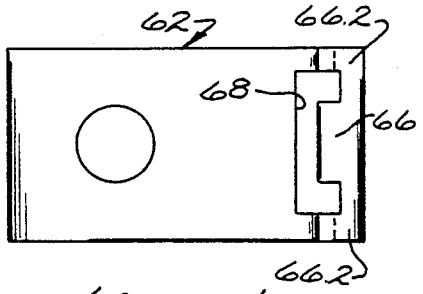

During assembly of the switch, stationary contact portion 64 is placed on hub portion 32.1 of base 30 with opposite edge portions 66.2 (see FIG. 5*b*) received on respective platforms 32.6. Once the stationary contact is secured to base 30 by means of riveting at 62 and movable contact arm 40 is snapped onto mounting portion 34 the device can be calibrated, if desired, by bending the bridge portion of free end 66 which extends between platforms 32.6.

After the movable contact has been snapped onto mounting portion 34 and disc 72 is placed in housing 12 the base is telescopically inserted into housing 12 until side wall 32 bottoms against annular portion 28 with distal end 49 of movable arm scraping along the inside surface of wall 18 to effect a good electrical connection therewith. Thus housing 12 serves as ground while connector 54 serves as the other terminal. Disc 72 is maintained in recess 24 by the bottom surfaces of walls 32.2, 32.4 as well as U-shaped portion 42 of movable arm 40.

A second "O" ring 74 is preferably used to provide a fluid tight seal and is received in a groove 76 formed in the outer peripheral section of base 30. The free distal end 18.2 of side wall 18 is then rolled over (see the dashed line indicating the wall prior to rolling) to sealingly clamp the housing to the base.

In operation when the temperature of disc 72 reaches its actuating temperature as a result of heat transferred to it through housing 12 it will snap to its opposite (upwardly concave—not shown) configuration. The central portion of the disc will react against protrusion 26 and the outer peripheral portion of the disc will contact end portion 48 of the movable contact arm and cause contact 50 to lift off and disengage stationary contact 70.

The present disclosure includes that contained in the appended claims, as well as that of the foregoing description. Although this invention has been described in its preferred form it is understood that this is by way of example and that numerous changes in the details of construction and the combination and arrangement of parts may be resorted to without departing from the spirit and the scope of the invention as hereinafter claimed. For example, the disc could be reversed so that the electrical circuit would close upon selected temperature rise rather than open.

What is claimed is:

1. A thermally responsive electric switch comprising a generally cup shaped housing formed of thermally and electrically conductive material having a bottom wall formed with a thermostatic disc seat in the bottom wall and having a generally cylindrical upstanding side wall extending from the bottom wall to define a switch cavity, an electrically insulative base member having a central hub portion and having a generally cylindrical depending side wall adapted to be telescopically and slidingly received within the side wall of the housing, means to secure the housing and base together, a bore formed through the hub, an electrical connector mounted in the bore, a stationary contact arm having a first portion connected to the connector and having a free distal end disposed in the switch chamber with a stationary contact mounted on the free distal end, an elongated movable contact arm formed of material having good electrical and spring characteristics, the movable contact arm having two opposite ends, one opposite end captured between the side walls of the housing and the base, a movable contact mounted on the other end with the other end extending into the switch cavity and adapted to move into and of engagement with the stationary contact, a thermostatic disc movable between oppositely dished configurations upon selected temperature conditions disposed on the disc seat, the movable contact arm having a portion bent out of the plane of the arm and extending toward an outer peripheral portion of the disc whereby movement of the disc from one of its configurations to the other configuration will transfer motion to the movable contact arm to disengage the movable contact from the stationary contact.

2. A thermally responsive electric switch according to claim 1 in which the side wall of the base member is formed with a mounting portion having flat parallelly extending surface areas and the one opposite end of the movable contact arm is formed into a generally U-shaped configuration which is received on the mounting portion of the base member side wall.

3. A thermally responsive electric switch according to claim 2 in which the one opposite end of the movable contact arm has a distal free end which is formed to extend outwardly in a lateral direction so that it scrapingly engages the side wall of the housing.

4. A thermally responsive electric switch according to claim 1 in which the stationary contact arm defines a window portion adjacent the free distal end thereof and the movable contact arm extends through the window portion.

5. A thermally responsive electric switch according to claim 4 in which the free distal end of the stationary contact lies in a plane which is displaced from a plane in which the first portion of the stationary contact lies.

6. A thermally responsive electric switch according to claim 1 in which the side wall of the housing has a free distal end which is rolled over the secure the housing and base together.

7. A thermally responsive electric switch according to claim 1 in which the bottom wall is formed with a recess therein to serve as the thermostatic disc seat and a projection is formed generally centrally in the disc seat to serve as a fulcrum for the thermostatic disc.

8. A thermally responsive electric switch according to claim 4 in which the base member has spaced platform portions on which opposite edge portions of the free distal end of the stationary contact are supported.

9. A thermally responsive electric switch comprising a generally cup shaped housing formed of thermally and electrically conductive material having a bottom wall formed with a thermostatic disc seat in the bottom wall and having a generally cylindrical upstanding side wall extending from the bottom wall to define a switch cavity, an electrically insulative base member adapted to be telescopically and slidingly received within the side wall of the housing, means to secure the housing and base together, a bore formed through the base member, an electrical connector mounted in the bore, a stationary contact means connected to the connector, an elongated movable contact arm formed of material having good electrical and spring characteristics, the movable contact arm having two opposite ends, one opposite end captured between the side walls of the housing and the base, a movable contact mounted on the other end with the other end extending into the switch cavity and adapted to move into and of engagement with the stationary contact means, a disc movable between oppositely dished configurations upon selected temperature conditions disposed on the disc seat, the movable contact arm having a portion bent out of the plane of the arm and extending toward an outer peripheral portion of the disc whereby movement of the disc from one of its configurations to the other configuration will transfer motion to the movable contact arm to disengage the movable contact from the stationary contact means.

* * * * *